US011373825B2

(12) United States Patent
Kinsel et al.

(10) Patent No.: US 11,373,825 B2
(45) Date of Patent: Jun. 28, 2022

(54) FAIL-SAFE LOCKOUT TRIP MECHANISM IN A CIRCUIT INTERRUPTING DEVICE

(71) Applicant: Siemens Industry, Inc., Alpharetta, GA (US)

(72) Inventors: Hugh T. Kinsel, Sugar Hill, GA (US); Joselito Endozo, Dacula, GA (US); Russell Thomas Watford, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 104 days.

(21) Appl. No.: 17/038,073

(22) Filed: Sep. 30, 2020

(65) Prior Publication Data

US 2022/0102097 A1 Mar. 31, 2022

(51) Int. Cl.

| | |
|---|---|
| ***H01H 37/66*** | (2006.01) |
| ***H01H 37/00*** | (2006.01) |
| ***H01H 83/20*** | (2006.01) |

(52) U.S. Cl.

CPC ..... *H01H 37/002* (2013.01); *H01H 37/66* (2013.01); *H01H 83/20* (2013.01); *H01H 2083/206* (2013.01)

(58) Field of Classification Search

CPC ..... H01H 73/14; H01H 71/62; H01H 71/40; H01H 71/123; H01H 71/128; H01H 71/1054; H01H 71/10; H01H 71/2418; H01H 83/04; H01H 83/02; H01H 83/20; H01H 75/04; H02H 3/335; H02H 3/338; H02H 3/162; H02H 3/05; H02H 3/085; H02H 3/066; H02H 3/04; H02H 3/347; H02H 3/3473

See application file for complete search history.

(56) References Cited

U.S. PATENT DOCUMENTS

| | | | | |
|---|---|---|---|---|
| 3,163,732 | A | 12/1964 | Abbott et al. | |
| 6,014,297 | A * | 1/2000 | Clarey | H02H 1/0015 361/45 |
| 2017/0256934 | A1 | 9/2017 | Kennedy et al. | |
| 2020/0211791 | A1 | 7/2020 | Manahan et al. | |

FOREIGN PATENT DOCUMENTS

| | | |
|---|---|---|
| EP | 0232172 A2 | 8/1987 |

* cited by examiner

*Primary Examiner* — Bryan R Perez

(57) ABSTRACT

A circuit interrupting device with a temperature activated permanent lockout trip mechanism is provided. The temperature activated permanent lockout trip mechanism is located in close proximity to a section of conductor that generates heat. An energized first solenoid generates a magnetic force capable of moving an armature that unlatches a latch releasing a spring to open a main contactor removing power from an electrical circuit. The temperature activated permanent lockout trip mechanism upon reaching a predetermined temperature which is higher than the predetermined temperature threshold of the temperature sensing switch also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device thus the circuit interrupting device is permanently disabled as the main contactor cannot be closed, and power no longer be reconnected to the electrical circuit.

20 Claims, 11 Drawing Sheets

FAIL-SAFE LOCKOUT TRIP MECHANISM IN A CIRCUIT INTERRUPTING DEVICE

BACKGROUND

1. Field

Aspects of the present invention generally relate to a fail-safe lockout trip mechanism in a circuit interrupting device.

2. Description of the Related Art

Electrical power is distributed to loads throughout buildings using insulated conductors of different sizes appropriate for the amplitude of current being delivered to the load. The amount of current for continuous safe operation for a particular wire gage size is known as rated current. If the rated current is exceeded, then the conductor will overheat to a point that the insulation melts resulting in hazardous conditions of electrical shock due to exposed voltage potential energy and of flame ignition due to exposed heat energy. Initially fuses were implemented to prevent these hazardous conditions resulting from overloading the electrical circuit. Fuses were eventually replaced by circuit breakers which function as resettable switches. The circuit breaker typical has a robust main contactor that is spring loaded, but held in a closed switch position using a latch. For hazardous overload current situations greater than approximately 800% to 1000% of rated current on the electrical circuit, the hazardous overload current itself is used to generate a magnetic force to unlatch the latch releasing a spring to open the contactor switch removing power from the electrical circuit. For hazardous overload current situations greater than 135% but less than approximately 800% to 1000%, a bimetallic device in series with the electrical current is situated near the latch such that heat generated by the overload current causes the bimetallic device to warp generating a force to unlatch the latch releasing a spring to open the contactor switch removing power from the electrical circuit. Presently, and in the very near future, alternative methods of detecting hazardous overload current are being developed that utilize a solenoid or an electromagnet to generate a magnetic force to unlatch the latch releasing a spring to open the contactor switch removing power from the electrical circuit. In many applications the solenoid or electromagnet is energized by a solid-state switch. Typically, the current utilized to energize the solenoid or electromagnet exceeds the rating of the wire used on the winding of the solenoid or electromagnet and of the rating of the solid-state switch and could potentially damage the solenoid or electromagnet and the solid-state switch if the response of the unlatching mechanism is sluggish and fails to remove power within a few cycles of being energized, or worse, fails to remove power at all. Thus, there is a need for a mechanism to permanently remove power from the electrical circuit should the solenoid or electromagnet or the solid-state switch became damaged and/or inoperable.

However, a fail-safe backup mechanism is not present to permanently remove power from the electrical circuit should the solenoid or electromagnet or the solid-state switch became damaged and/or inoperable.

Therefore, there is a need for providing a fail-safe lockout trip mechanism in a circuit interrupting device.

SUMMARY

Briefly described, aspects of the present invention relate to a fail-safe lockout trip mechanism that solves the above set forth problem by utilizing fusible metal such as solder or a low-melting point metal alloy to hold a plunger in place that has a constant force exerted on it by either a compressed or stretched spring. The device is located near a conductor that generates heat and configured such that when the fusible metal melts the plunger is released allowing the spring to convert its potential energy into kinetic energy, moving the plunger to generate a force to unlatch a latch releasing a spring to open main contactor switch removing power from an electrical circuit. Thereafter, the constant force generated by the spring on the plunger inhibits a circuit breaker from resetting which permanently prevents reconnecting power to the electrical circuit. The present invention provides a method and an apparatus to generate a force to unlatch the latch releasing a spring to open the main contactor removing power from the electrical circuit within the calibration trip time limits specified in UL489 should the solenoid or electromagnet or a thermal or solid-state switch became damaged and/or inoperable. In addition, the present invention also permanently prevents the device from being turned back on and re-applying power to the electrical circuit. This invention is simple in construction, easy to manufacture/assemble, and consists of low-cost components which makes the invention ideal for mass production. Ultimately, this invention provides a fail-safe backup mechanism to permanently remove power from the electrical circuit within the calibration trip time limits specified in UL489 should the solenoid or electromagnet or the thermal or solid-state switch became damaged and/or inoperable.

In accordance with one illustrative embodiment of the present invention, a circuit interrupting device is provided. It comprises an energizing conductor, a main contactor that is spring loaded but held in a closed switch position using a latch and a first electromagnetic device configured to instantaneously generate a magnetic force capable of unlatching the latch releasing a spring to open the main contactor removing power from an electrical circuit when an overload current exceeds a predetermined % of a rated load current. It further comprises a section of conductor that generates heat and a temperature sensing switch having contacts. The temperature sensing switch is located in close proximity to the section of conductor which closes the contacts when a temperature reaches a predetermined temperature threshold in response to an overload current less than the predetermined % of a rated load current. It further comprises a second electromagnet in the form of a first solenoid such that when the temperature sensing switch is closed the first solenoid is disposed across the energizing conductor and a connection to a neutral conductor and a temperature activated permanent lockout trip mechanism located in close proximity to the section of conductor that generates heat. The energized first solenoid generates a magnetic force capable of moving an armature that unlatches the latch releasing the spring to open the main contactor removing power from the electrical circuit. The temperature activated permanent lockout trip mechanism upon reaching a predetermined temperature which is higher than the predetermined temperature threshold of the temperature sensing switch also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device thus the circuit interrupting device is permanently disabled as the main contactor cannot be closed, and power no longer be reconnected to the electrical circuit.

In accordance with one illustrative embodiment of the present invention, a method is provided for fail-safe lockout trip in a circuit interrupting device. The method comprises providing a energizing conductor, providing a main contactor that is spring loaded but held in a closed switch position using a latch and providing a first electromagnetic device configured to instantaneously generate a magnetic force capable of unlatching the latch releasing a spring to open the main contactor removing power from an electrical circuit when an overload current exceeds a predetermined % of a rated load current. The method further comprises providing a section of conductor that generates heat and providing a temperature sensing switch having contacts. The temperature sensing switch is located in close proximity to the section of conductor which closes the contacts when a temperature reaches a predefined temperature threshold in response to an overload current less than the predetermined % of a rated load current. The method further comprises providing a second electromagnet in the form of a first solenoid such that when the temperature sensing switch is closed the first solenoid is disposed across the energizing conductor and a connection to a neutral conductor. The method further comprises providing a temperature activated permanent lockout trip mechanism located in close proximity to the section of conductor that generates heat. The energized first solenoid generates a magnetic force capable of moving an armature that unlatches the latch releasing the spring to open the main contactor removing power from the electrical circuit. The temperature activated permanent lockout trip mechanism upon reaching a predefined temperature which is higher than the predetermined temperature threshold of the temperature sensing switch also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device thus the circuit interrupting device is permanently disabled as the main contactor cannot be closed, and power no longer be reconnected to the electrical circuit.

In accordance with one another illustrative embodiment of the present invention, a circuit interrupting device is provided. A circuit interrupting device with a temperature activated permanent lockout trip mechanism is provided. The temperature activated permanent lockout trip mechanism is located in close proximity to a section of conductor that generates heat. An energized first solenoid generates a magnetic force capable of moving an armature that unlatches a latch releasing a spring to open a main contactor removing power from an electrical circuit. The temperature activated permanent lockout trip mechanism upon reaching a predetermined temperature which is higher than the predetermined temperature threshold of the temperature sensing switch also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device thus the circuit interrupting device is permanently disabled as the main contactor cannot be closed, and power no longer be reconnected to the electrical circuit.

BRIEF DESCRIPTION OF THE DRAWINGS

FIG. 15 illustrates a schematic view of a flow chart of a method for fail-safe lockout trip in a circuit interrupting device in accordance with an exemplary embodiment of the present invention.

DETAILED DESCRIPTION

Figure 1:
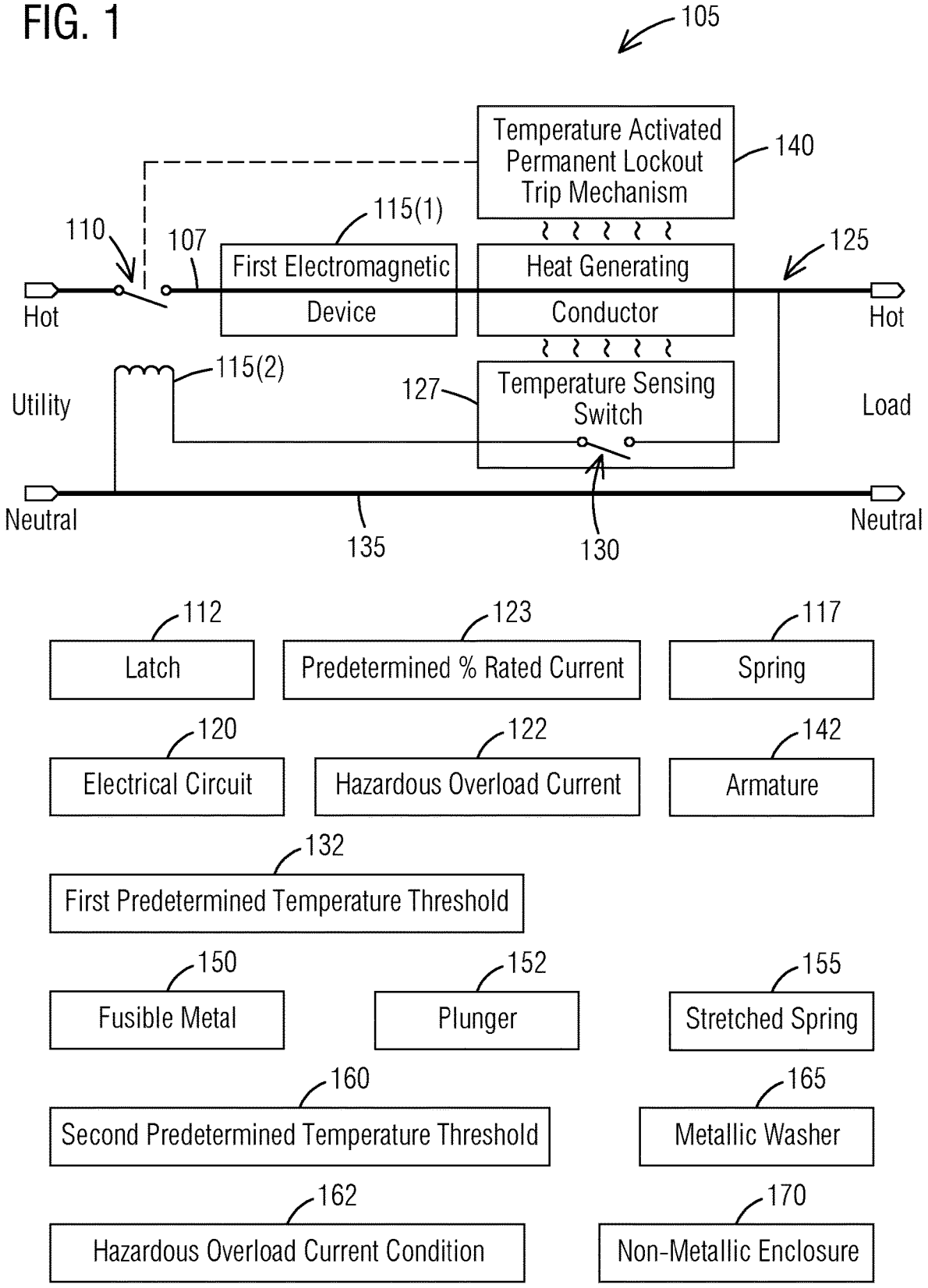
FIG. 1 illustrates a circuit interrupting device with a temperature activated permanent lockout trip mechanism in accordance with an exemplary embodiment of the present invention.

To facilitate an understanding of embodiments, principles, and features of the present invention, they are explained hereinafter with reference to implementation in illustrative embodiments. In particular, they are described in the context of a circuit interrupting device with a temperature activated permanent lockout trip mechanism. The temperature activated permanent lockout trip mechanism is located in close proximity to a section of conductor that generates heat. An energized first solenoid generates a magnetic force capable of moving an armature that unlatches a latch releasing a spring to open a main contactor removing power from an electrical circuit. The temperature activated permanent lockout trip mechanism upon reaching a predetermined temperature also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device thus the circuit interrupting device is permanently disabled, and power can no longer be reconnected to the electrical circuit. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the circuit interrupting device according to the present disclosure are described below with reference to FIGS. 1-15 herein. Like reference numerals used in the drawings identify similar or identical elements throughout the several views. The drawings are not necessarily drawn to scale.

Consistent with one embodiment of the present invention, FIG. 1 represents a block diagram of a circuit interrupting device 105 that provides fail-safe lockout trip in accordance with an exemplary embodiment of the present invention. The circuit interrupting device 105 comprises a hot or energizing conductor 107 and a main contactor 110 that is spring loaded but held in a closed switch position using a latch 112. The circuit interrupting device 105 further comprises a first electromagnetic device 115(1) configured to instantaneously generate a magnetic force utilizing a hazardous overload current 122 to do so that is capable of unlatching the latch 112 releasing a spring 117 to open the main contactor 110 removing power from an electrical circuit 120 when a hazardous overload current 122 exceeds a predetermined % (e.g., 800%) of a rated load current 123. The circuit interrupting device 105 further comprises a section of conductor 125 that generates heat.

The circuit interrupting device 105 further comprises a temperature sensing switch 127 having contacts 130. The temperature sensing switch 127 is located in close proximity to the section of conductor 125 that generates heat and closes the contacts 130 when a temperature reaches a first predetermined temperature threshold 132 in response to a hazardous overload current less than the predetermined % of a rated load current. The circuit interrupting device 105 further comprises a second electromagnetic device or a second electromagnet 115(2) in the form of a first solenoid such that when the contact 130 of the temperature sensing switch 127 is closed the first solenoid is disposed across the hot conductor 107 and a connection to a neutral conductor 135. The circuit interrupting device 105 further comprises a temperature activated permanent lockout trip mechanism 140 located in close proximity to the section of conductor 125 that generates heat.

The energized first solenoid generates a magnetic force capable of moving an armature 142 that unlatches the latch 112 releasing the spring 117 to open the main contactor 110 removing power from the electrical circuit 120. The temperature activated permanent lockout trip mechanism 140 upon reaching a second predetermined temperature threshold 160 which is higher than the first predetermined temperature threshold 132 of the temperature sensing switch 127 also generates a mechanical force capable of moving the armature 142 that unlatches the latch 112 releasing the spring 117 to open the main contactor 110 removing power from the electrical circuit 120. Once activated, the temperature activated permanent lockout trip mechanism 140 inhibits the latch 112 from latching which prevents a reset of the circuit interrupting device 105 thus the circuit interrupting device 105 is permanently disabled, and power can no longer be reconnected to the electrical circuit 120.

The temperature activated permanent lockout trip mechanism 140 is a fail-safe backup mechanism to permanently remove power from the electrical circuit 120 within calibration trip time limits specified in UL489 should the first solenoid or the second electromagnet 115(2) or a thermal or a solid-state switch or temperature sensing switch 127 becomes damaged and/or inoperable. The temperature activated permanent lockout trip mechanism 140 comprises fusible metal 150 to hold a plunger 152 in place that has a constant force exerted on it by either a compressed or a stretched spring 155. The fusible metal 150 is located near the section of conductor 125 that generates heat and configured such that when the fusible metal 150 melts the plunger 152 is released allowing the spring 155 to convert its potential energy into kinetic energy, moving the plunger 152 to generate a mechanical force to unlatch the latch 112 releasing the spring 117 to open the main contactor 110 removing power from the electrical circuit 120.

In one embodiment, the temperature activated permanent lockout trip mechanism 140 comprises a low-melting point metal or metal alloy. In another embodiment, the temperature activated permanent lockout trip mechanism 140 comprises solder or Indium 100.

The temperature sensing switch 127 is a normally open "make" switch that closes the contacts 130 at the first predetermined temperature threshold 132. The first predefined temperature threshold 132 and the second predetermined temperature threshold 160 are selected to ensure compliance with a safety standard UL489. The first predefined temperature threshold 132 of the temperature sensing switch 127 is selected to ensure compliance of a safety standard UL489, but at a lower temperature than the second predefined temperature threshold 160 of the temperature activated permanent lockout trip mechanism 140.

This enables the circuit interrupting device 105 to then be reset under normal operation after a response to a hazardous overload current condition 162 by latching the latch 112 again and once reset, the circuit interrupting device 105 can be turned back on by moving a handle, applying power to the electrical circuit 120 once again by closing the main contactor 110.

According to one embodiment, the temperature activated permanent lockout trip mechanism 140 consists of the non-metallic plunger 152, the metal spring 155 and a metallic washer 165. In one embodiment, the fusible metal 150 is fused to the metallic washer 165 in two places positioned in grooves of the non-metallic plunger 152 such that when the temperature of the fusible metal 150 reaches its melting point the fusible metal 150 becomes a liquid and is no longer affixed to the metallic washer 165, allowing the non-metallic plunger 152 to move in the direction of the trip armature 142.

The circuit interrupting device 105 further comprises the trip armature 142 that is configured to unlatch the latch 112 when force is applied by the non-metallic plunger 152, releasing the spring 117 to open the main contactor 110 thus removing power from the electrical circuit 120. The circuit interrupting device 105 further comprises a non-metallic enclosure 170 for the circuit interrupting device 105 that holds the temperature activated permanent lockout trip mechanism 140 in place and provides a fixed-point reference for a spring force.

The first predefined temperature threshold 132 of the thermal sensing switch 127 is selected to ensure that the circuit interrupting device 105 complies with safety standard UL489. The second predefined temperature threshold 160 of the temperature activated permanent lockout trip mechanism 140 is also selected to ensure compliance of safety standard UL489, but at a higher temperature than the first predefined temperature threshold 132 of the temperature sensing switch 127. This allows the temperature sensing switch 127 to energize the solenoid generating a force that unlatches the latch 112 releasing the spring 117 to open the main contactor 110 removing power from the electrical circuit 120 prior to activation of the temperature activated permanent lockout trip mechanism 140 during the hazardous overload current condition 162 as the temperature of the heat generating conductor 125 rises. The temperature of the heat generating conductor 125 recedes once power is removed from the load ending the hazardous overload current condition 162 and leaving the temperature activated permanent lockout trip mechanism 140 inactivated. The contacts 130 of the temperature sensing switch 127 re-open as the temperature recedes below the first predetermined temperature threshold 132. The circuit interrupting device 105 can then be reset by latching the latch 112 again. Once reset, the circuit interrupting device 105 can be turned back on, applying power to the electrical circuit 120 once again by closing the main contactor 110. Obviously, it is recommended to investigate and remove the hazardous overload current condition 162 in the electrical circuit 120 prior to resetting a circuit breaker and turning it back on. However, should the temperature sensing switch 127 or the solenoid become damaged or reach its end of life, the solenoid does not become energized or does not generate sufficient force to unlatch the latch 112. Thus, the main contactor 110 remains closed and the hazardous overload current condition 162 persists. As a result, the temperature of the heat generating conductor 125 continues to rise until it reaches a predefined temperature of the temperature activated permanent lockout trip mechanism 140, at which point the temperature activated permanent lockout trip mechanism 140 generates a force moving an armature 142 that unlatches the latch 112 releasing the spring 117 to open the main contactor 110 removing power from the electrical circuit 120. The temperature activated permanent lockout trip mechanism 140 also inhibits the latch 112 from latching again preventing the circuit interrupting device 105 from being reset, permanently disabling the device from ever closing the main contactor 110 and reconnecting power to the electrical circuit 120.

Figure 2:
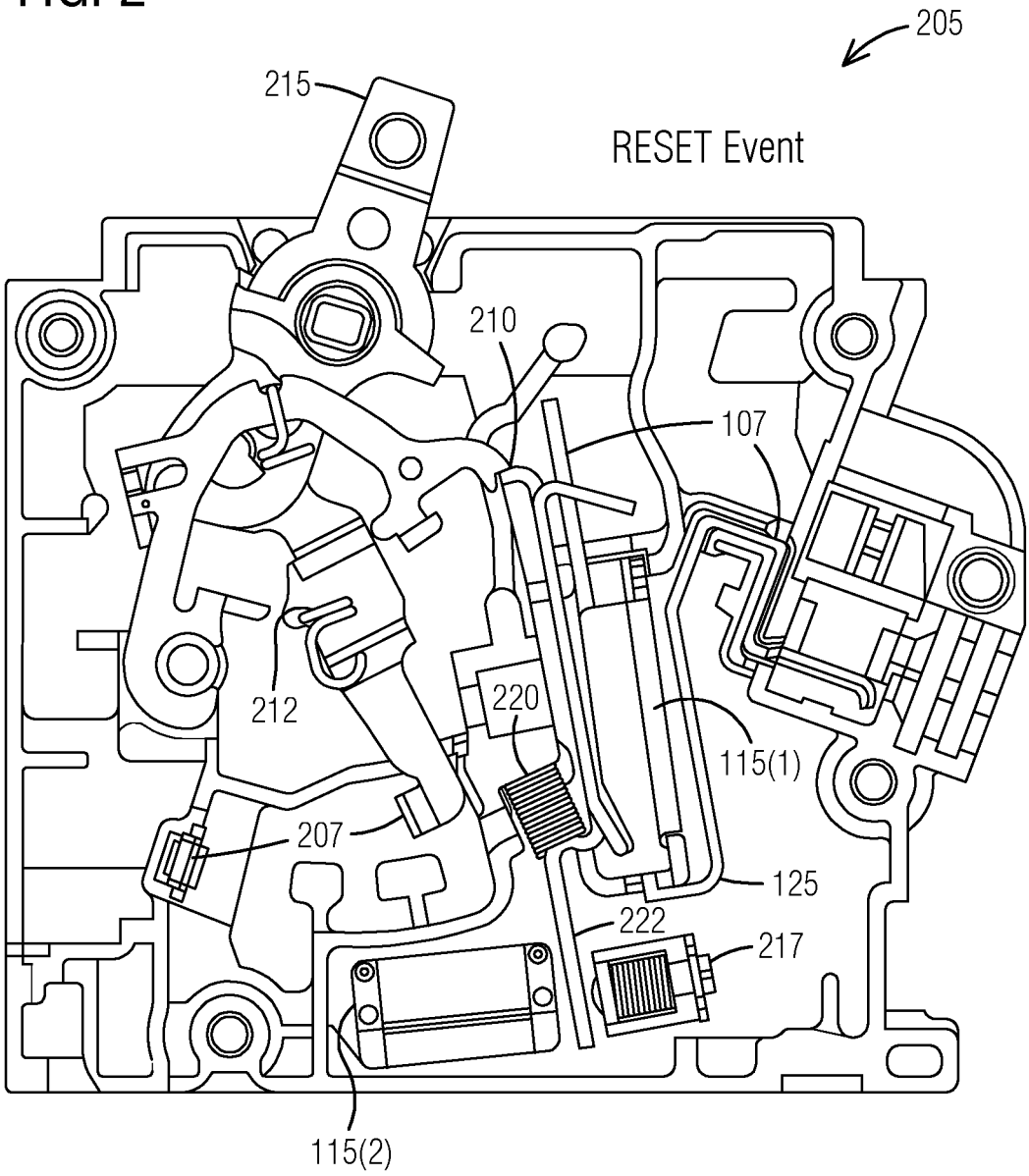
FIG. 2 illustrates an embodiment in its mechanical form when the circuit interrupting device is in a "Reset" state where the main contactor is open and the latch is latched, loading a spring of the main contactor.
Figure 3:
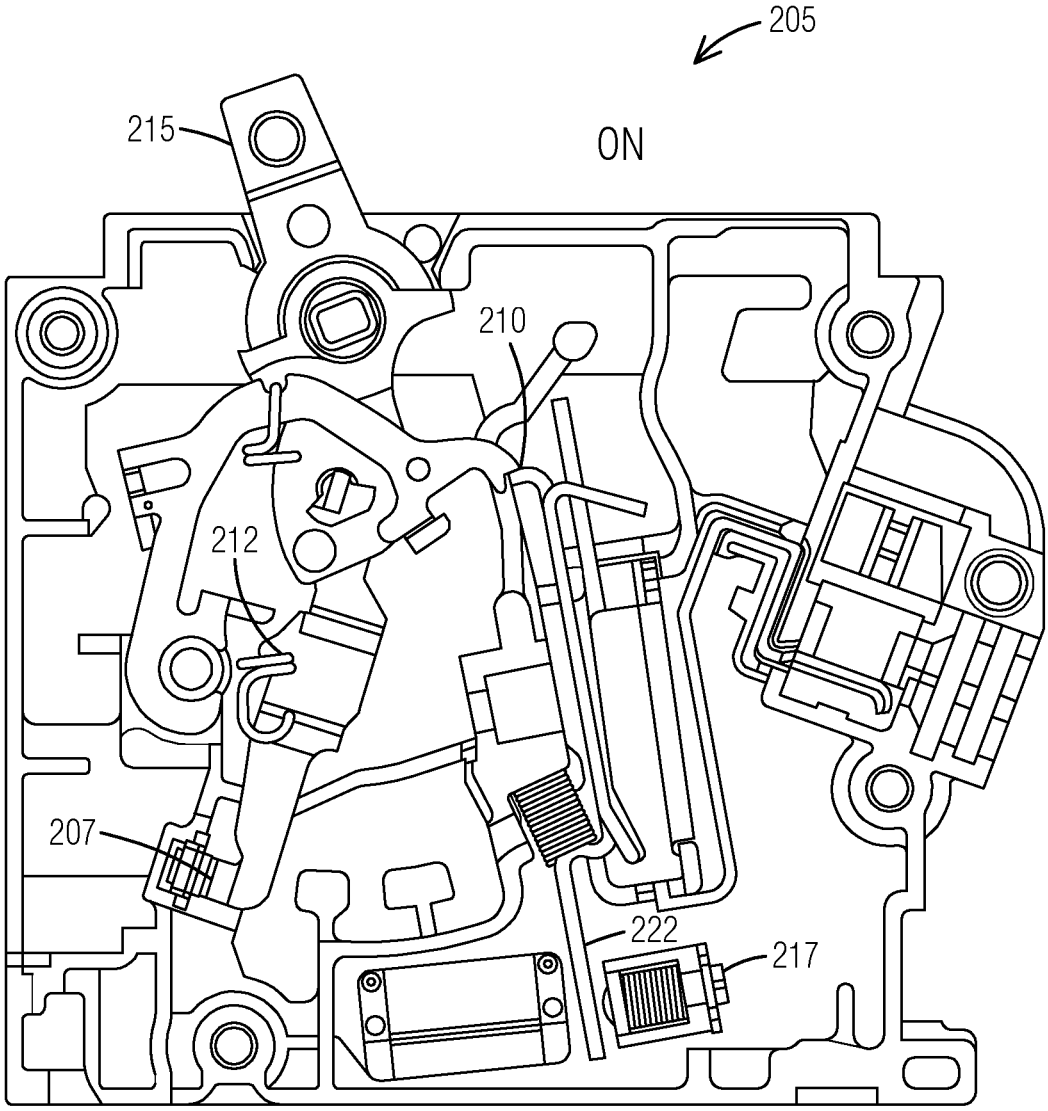
FIG. 3 illustrates shows an embodiment in its mechanical form when the circuit interrupting device is in an "On" state where the main contactor is closed by moving the handle.
Figure 4:
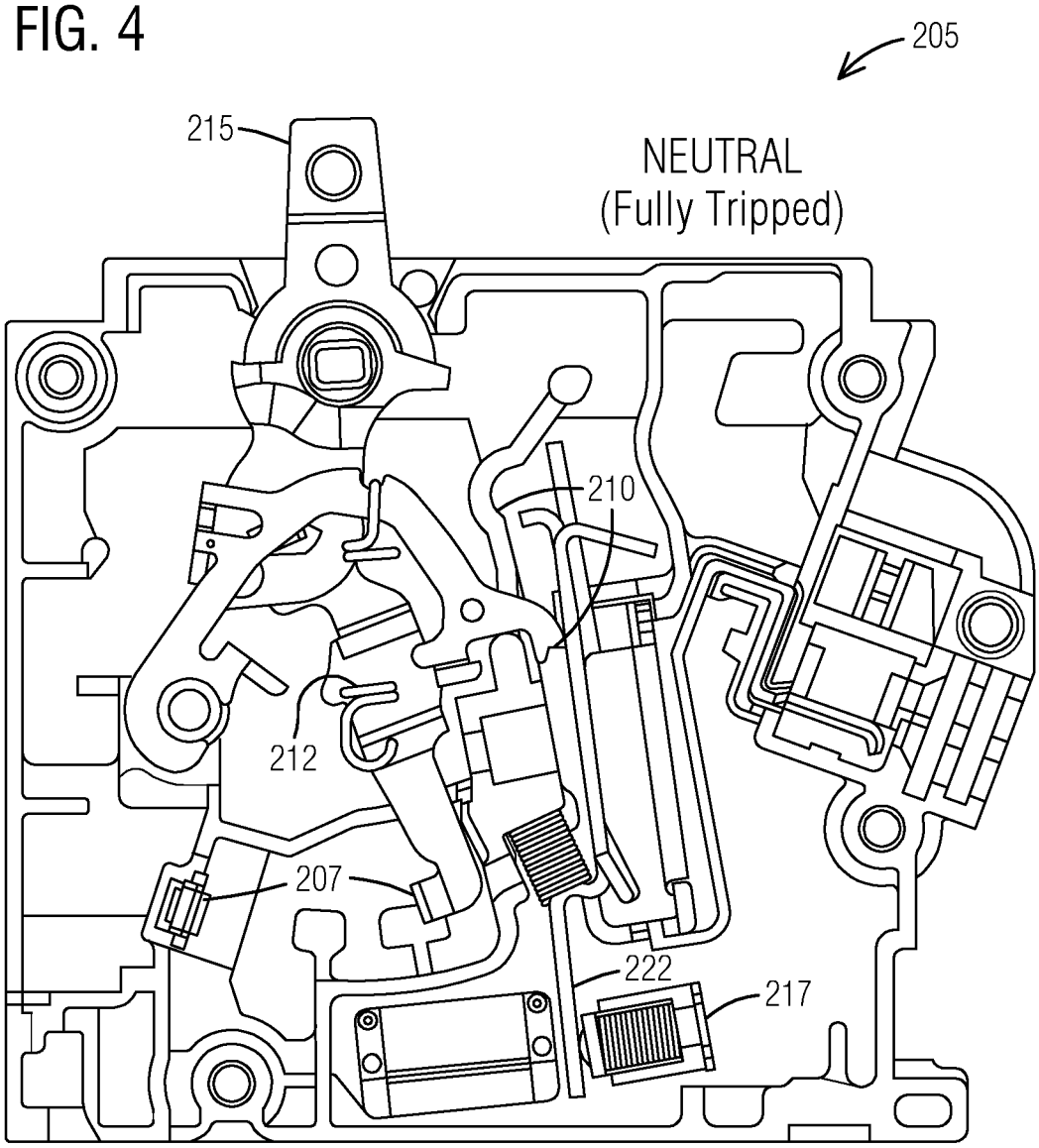
FIG. 4 illustrates an embodiment in its mechanical form when the circuit interrupting device is in a "Tripped" state as a result of the temperature activated permanent lockout trip mechanism being activated.

Referring to FIG. 2, it illustrates an embodiment in its mechanical form when a circuit interrupting device 205 is in a "Reset" state where a main contactor 207 is open and a latch 210 is latched, loading a spring 212 of the main contactor 207. Turning now to FIG. 3, it illustrates an embodiment in its mechanical form when the circuit interrupting device 205 is in an "On" state where the main contactor 207 is closed by moving a handle 215. FIG. 4 illustrates an embodiment in its mechanical form when the circuit interrupting device 205 is in a "Tripped" state as a result of a temperature activated permanent lockout trip mechanism 217 being activated.

A "Reset" state is accomplished by moving the handle 215 from the "Tripped" position shown in FIG. 4 to the "Reset" position in FIG. 2. A different spring 220 holds a trip armature 222 in place. FIG. 3 shows the embodiment in its mechanical form when the circuit interrupting device 205 is in the "On" state where the main contactor 207 is closed by moving the handle 215. FIG. 4 shows the embodiment in its mechanical form when the circuit interrupting device 205 is in the "Tripped" state as a result of the temperature activated permanent lockout trip mechanism 217 being activated. The temperature activated permanent lockout trip mechanism 217 is shown exerting force on the trip armature 222 which unlatched the latch 210 releasing the spring 212 of the main contactor 207 which opens and moves the handle 215 to the "Tripped" position. The continuous force exerted by the temperature activated permanent lockout trip mechanism 217 on the trip armature 222 prevents the latch 210 from latching when attempting to "reset" the circuit interrupting device 205 by moving the handle 215 to the "Reset" position.

Paragraph 7.1.2. in UL489 describes a calibration test for a circuit interrupting device or a circuit breaker. So for the 200 percent calibration test and the 135 percent calibration test which are performed at 25° C. ambient temperature, a 15 A to 30 A rated circuit breaker must trip within 2 minutes while carrying 200 percent of its rated current, and within 1 hour while carrying 135 percent of its rated current. And for the 100 percent calibration test which is performed at 40° C. ambient temperature, the circuit breaker shall not trip while carrying 100 percent of its rated current until its temperatures have stabilized.

Figure 5:
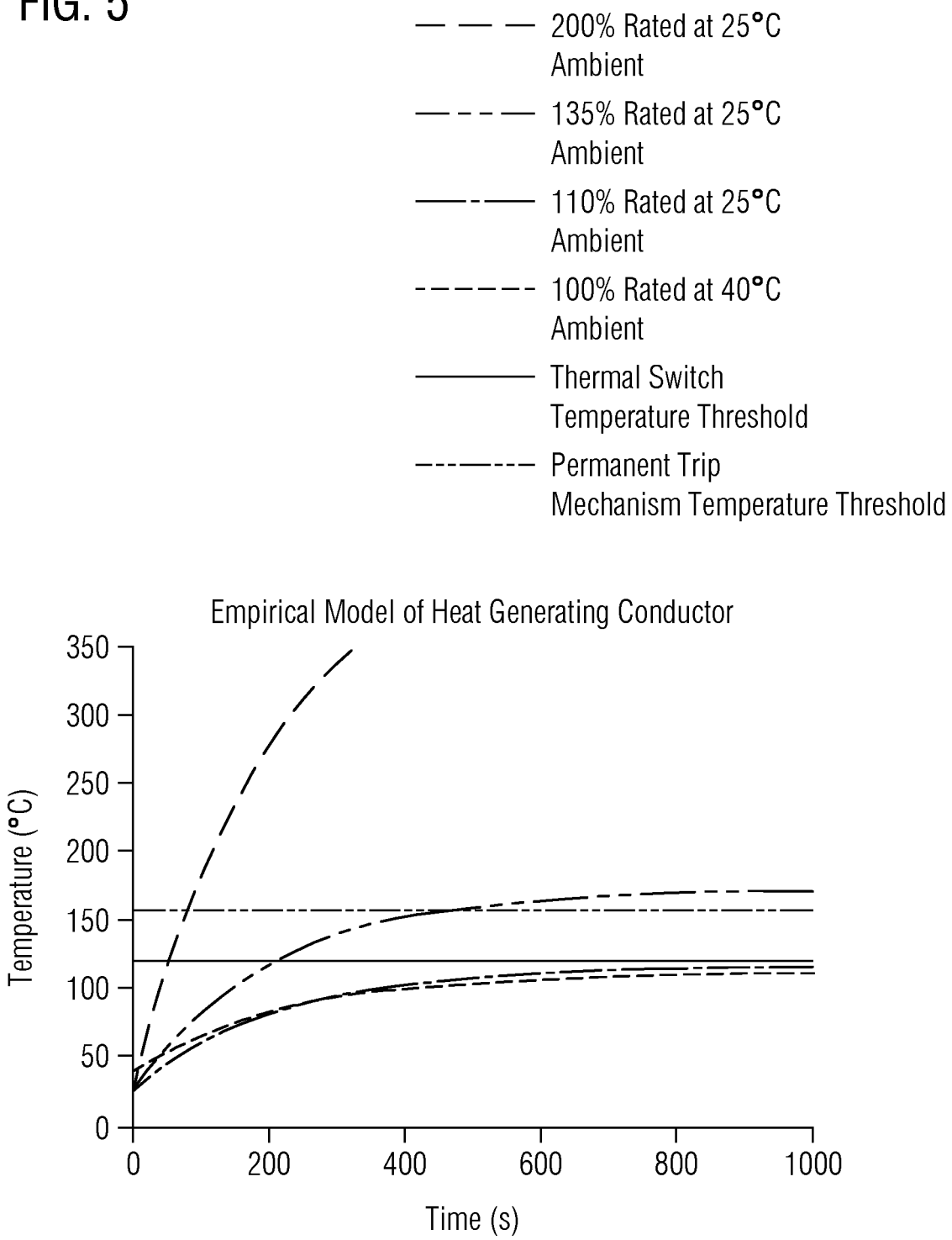
FIG. 5 illustrates an empirical model of the temperature vs. time characteristic of a heat generating conductor section of a 20 A rated circuit breaker during the various calibration tests.

As seen in FIG. 5, it illustrates an empirical model of the temperature vs. time characteristic of a heat generating conductor section of a 20 A rated circuit breaker during the various calibration tests. A predetermined temperature threshold of the temperature sensing switch 127 is set to approximately 120° C. to achieve a trip time of approximately 55 seconds while carrying 200 percent of its rated current (25° C. ambient), a trip time of approximately 3.5 minutes while carrying 135 percent of its rated current (25° C. ambient), and to not trip while carrying 100 percent of its rated current (40° C. ambient), which are well within the test limits described in UL489. A predetermined temperature threshold of the temperature activated permanent lockout trip mechanism 140 is set to a higher temperature of approximately to 157° C. to achieve a trip time of approximately 81 seconds while carrying 200 percent of its rated current (25° C. ambient), a trip time of approximately 7.4 minutes while carrying 135 percent of its rated current (25° C. ambient), and to not trip while carrying 100 percent of its rated current (40° C. ambient), which also are well within the test limits described in UL489.

Figure 6:
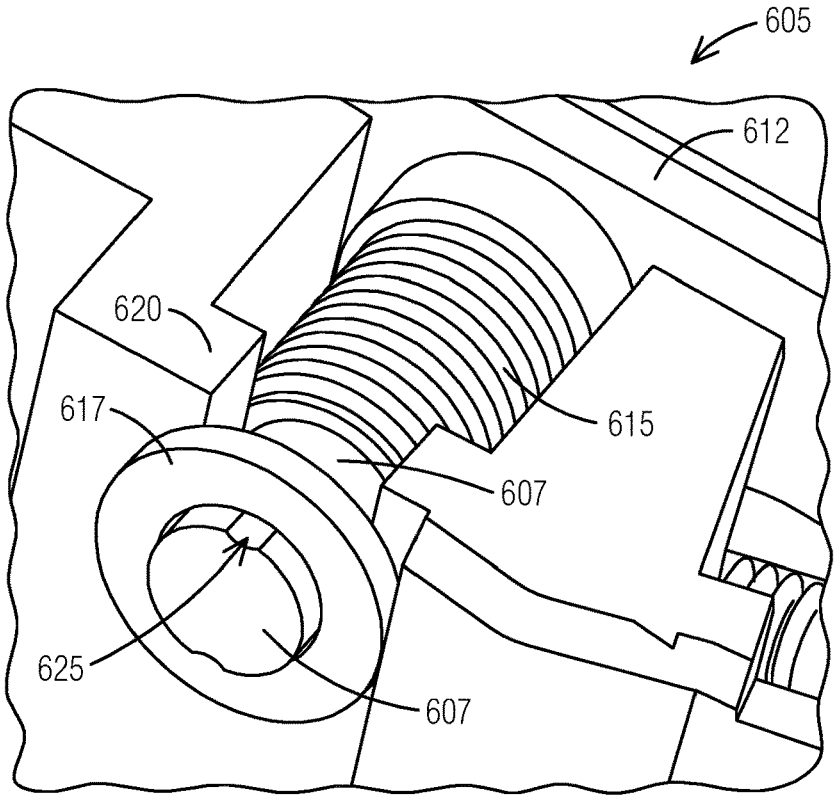
FIG. 6 illustrates a perspective view of a temperature activated permanent lockout trip mechanism in accordance with an exemplary embodiment of the present invention.
Figure 7:
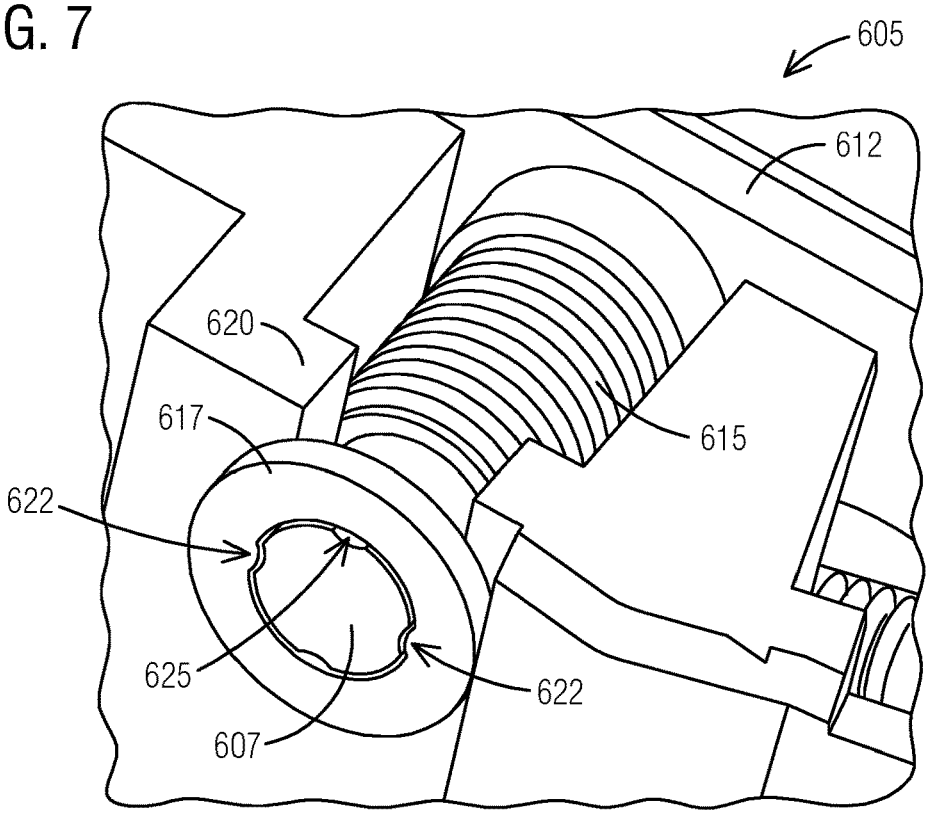
FIG. 7 illustrates a cut-away section view of the temperature activated permanent lockout trip mechanism in accordance with an exemplary embodiment of the present invention.

As shown in FIG. 6, it illustrates a perspective view of a temperature activated permanent lockout trip mechanism 605 in accordance with an exemplary embodiment of the present invention. In FIG. 7, it illustrates a cut-away section view of the temperature activated permanent lockout trip mechanism 605 in accordance with an exemplary embodiment of the present invention. With regard to FIG. 8, it illustrates a perspective view of groove detail of a non-metallic plunger 607 of the temperature activated permanent lockout trip mechanism 605 in accordance with an exemplary embodiment of the present invention. With respect to FIG. 9, it illustrates that a force of a compressed spring 615 against the fixed reference of an enclosure and the cap 628 of the non-metallic plunger 607 moves the non-metallic plunger 607 in the direction of a trip armature 612 and applies a continuous force on the trip armature 612 in accordance with an exemplary embodiment of the present invention.

Figure 8:
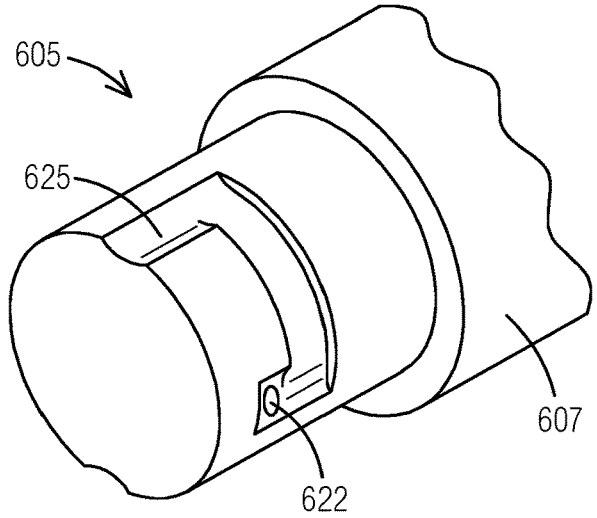
FIG. 8 illustrates a perspective view of groove detail of a non-metallic plunger of the temperature activated permanent lockout trip mechanism in accordance with an exemplary embodiment of the present invention.
Figure 9:
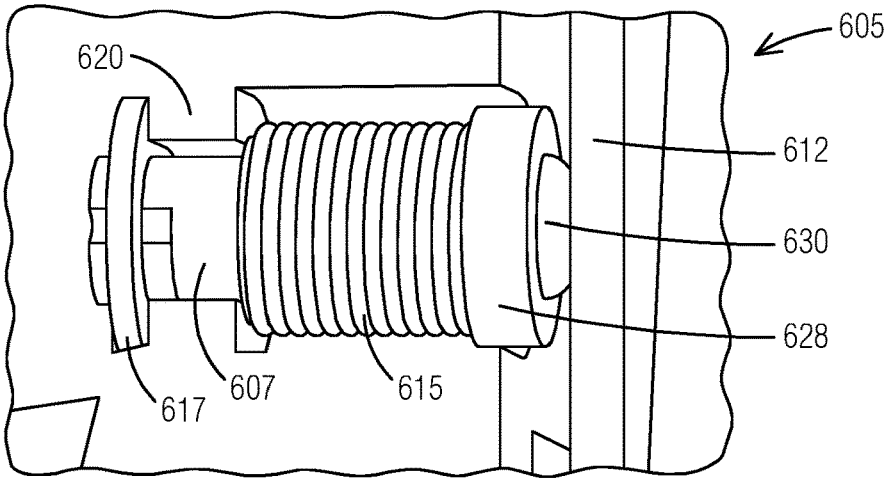
FIG. 9 illustrates that a force of a compressed spring against the fixed reference of an enclosure and the cap of a plunger moves the plunger in the direction of a trip armature and applies a continuous force on the trip armature in accordance with an exemplary embodiment of the present invention.

One embodiment of the temperature activated permanent lockout trip mechanism 605 is described in FIGS. 6-9. The temperature activated permanent lockout trip mechanism 605 consists of the non-metallic plunger 607, a metal spring 615, and a metallic washer 617 as shown in FIG. 6. Also shown in FIG. 6 is the trip armature 612 that is configured to unlatch the latch 112 in FIG. 1 when force is applied by the plunger 607 releasing a spring to open the main contactor 110 in FIG. 1 removing power from the electrical circuit 120. A non-metallic enclosure 620 for a circuit breaker holds the temperature activated permanent lockout trip mechanism 605 in place and provides a fixed-point reference for the spring force. A fusible metal such as solder 622 is fused to a metallic washer 617 in two places positioned in grooves of the non-metallic plunger 607. There are a variety of fusible metal alloys commercially available with various precise melting points ranging from approximately 90° C. to 450° C. 'Indium 100' is the fusible metal selected for this embodiment because it has a precise melting point of 157° C. A groove detail 625 of the non-metallic plunger 607 is shown in FIG. 8. When the temperature of the solder 622 reaches its melting point, the solder 622 becomes a liquid and is no longer affixed to the metallic washer 617 allowing the plunger 607 to move in the direction of the trip armature 612. The force of the compressed spring 615 against the fixed reference of the enclosure 620 and the cap 628 of the plunger 607 moves the plunger 607 in the direction of a trip armature 612 and applies a continuous force on the trip armature 612 as shown in FIG. 9. The applied force moves the trip armature 612 that unlatches the latch 112 releasing a spring to open the main contactor 110 removing power from the electrical circuit 120. The continuous force applied to the trip armature 612 inhibits the latch 112 from latching which permanently prevents a reset, disabling the main contactor 110 from ever closing again and reconnecting power to the electrical circuit 120. The top of a cap 628 of the plunger 607 has a rounded bump 630 shown in FIG. 9 that allows for a tangential plane to contact the trip armature 612 to apply a force normal to a plane.

Figure 10:
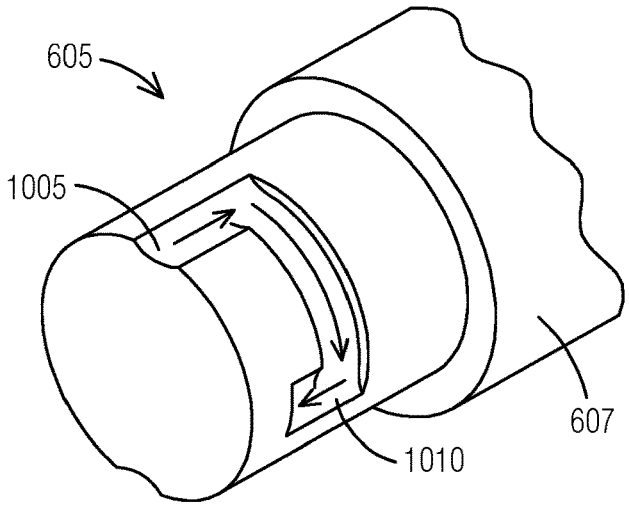
FIG. 10 illustrates a perspective view of grooves on an end of the plunger in accordance with an exemplary embodiment of the present invention.

FIG. 10 illustrates a perspective view of grooves 1005 on an end of the plunger 607 in accordance with an exemplary embodiment of the present invention. The temperature activated permanent lockout trip mechanism 605 is easy to assemble. A template tool is used to fuse solder 622 to locations on the inner diameter of the washer 617. The spring 615 is slid over the grooved end of the plunger 607 until it rests against the cap 628. Once cooled below the melting point of the solder 622, the washer 617 with the fused solder 622 is slid over the grooved end of the plunger 607 by aligning the fused solder locations on the washer with the grooves 1005 on the end of the plunger 607. The washer 617 with the fused solder 622 is slid up a groove 1010 until it stops, and then rotated clockwise until it stops and then receded until it stops where it is seated in its final position. A tool is used to compress the spring 615 and seat the temperature activated permanent lockout trip mechanism 605 into the non-metallic enclosure 620. And the total cost of the non-metallic plunger 607, the spring 615, and the washer 617 is only a few cents at high quantities.

Figure 11:
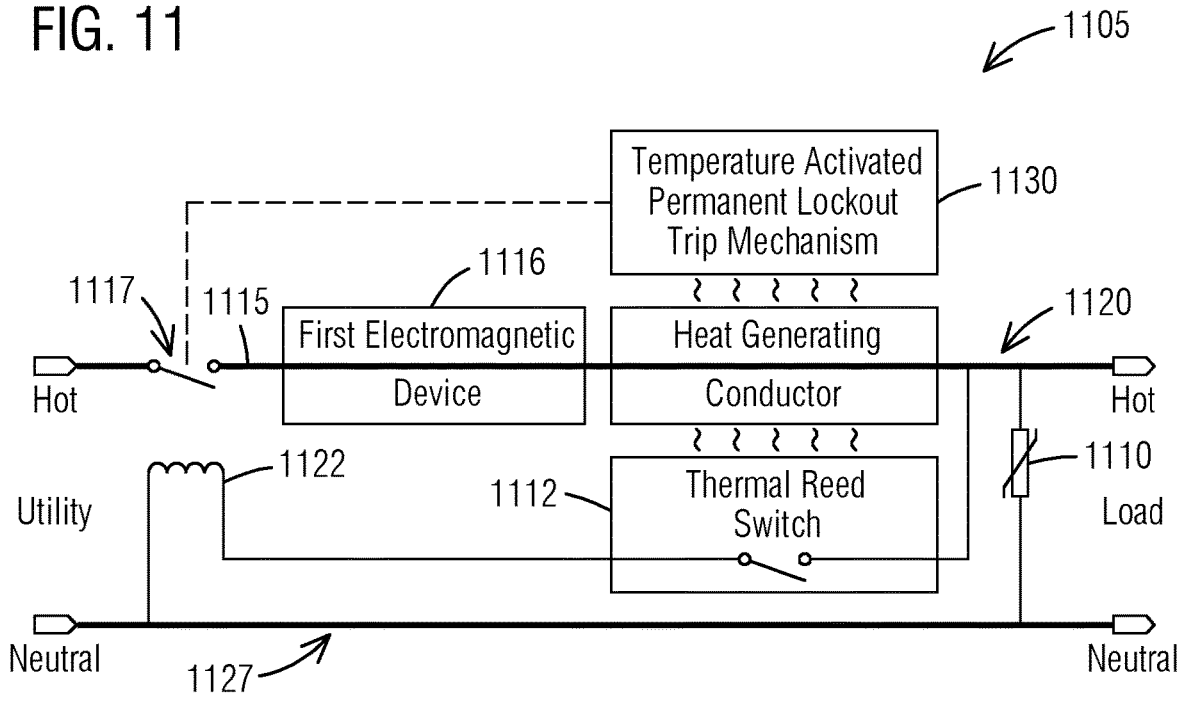
FIG. 11 illustrates a circuit interrupting device with a temperature activated permanent lockout trip mechanism and an optional Metal Oxide Varistor (MOV) to protect a Thermal Reed Switch from high voltage surges in accordance with an exemplary embodiment of the present invention

FIG. 11 illustrates a circuit interrupting device 1105 with a temperature activated permanent lockout trip mechanism 1130 and an optional Metal Oxide Varistor (MOV) 1110 to protect a Thermal Reed Switch 1112 from high voltage surges in accordance with an exemplary embodiment of the present invention. The circuit interrupting device 1105 comprises of a hot or energizing conductor 1115, a main contactor 1117 that is spring loaded but held in a closed switch position using a latch. A first electromagnetic device 1116 is configured to instantaneously generate magnetic force capable of unlatching the latch releasing a spring to open the main contactor 1117 removing power from an electrical circuit when a hazardous overload current exceeds 800% of rated load current. The circuit interrupting device 1105 further comprises a section of conductor 1120 that generates heat and the Thermal Reed Switch 1112 (part number TRS3-120MCR00VU manufactured by Kemet Electronics Corporation) located in close proximity to the section of conductor 1120 that generates heat, which closes its contacts when the Currie temperature of 120° C. is reached in response to a hazardous overload current.

The circuit interrupting device 1105 further comprises a second electromagnet in the form of a first solenoid 1122 such that when a temperature sensing switch is closed it is disposed across the hot conductor 1115 and a connection to a neutral conductor 1127. The temperature activated permanent lockout trip mechanism 1130 utilizing the fusible metal 'Indium 100' as described above in FIGS. 6-9 is located in close proximity to the section of conductor 1120 that generates heat. The energized solenoid 1122 generates a magnetic force capable of moving an armature that unlatches the latch releasing a spring to open the main contactor 1117 removing power from the electrical circuit. The temperature activated permanent lockout trip mechanism 1130 upon reaching the fusible metal' melting temperature of 157° C. also generates a force capable of moving an armature that unlatches the latch releasing a spring to open the main contactor 1117 removing power from the electrical circuit. Once activated, the temperature activated permanent lockout trip mechanism 1130 inhibits the latch from latching which permanently prevents a reset, disabling the main contactor 1117 from ever closing again and reconnecting power to the electrical circuit. The optional Metal Oxide Varistor (MOV) 1110 part number ERZE11A241 manufactured by Panasonic may be disposed across the hot conductor 1115 and a connection to the neutral conductor 1127 to protect the Thermal Reed Switch 1112 from high voltage surges.

The Thermal Reed Switch 1112 (part number TRS3-120MCR00VU manufactured by Kemet Electronics Corporation) which makes closed contact at 120° C. is selected to ensure compliance of safety standard UL489. 'Indium 100' which has a melting point of 157° C. is selected to activate the temperature activated permanent lockout trip mechanism 1130 at a higher temperature than the Thermal Reed Switch 1112 and still ensure compliance of safety standard UL489 should the Thermal Reed Switch 1112 or the solenoid 1122 become damaged or reach its end of life such that the solenoid 1122 does not become energized or does not generate sufficient force to unlatch the latch. This allows the Thermal Reed Switch 1112 to energize the solenoid 1122 generating a force that unlatches the latch releasing a spring to open the main contactor 1117 removing power from the electrical circuit prior to activation of the temperature activated permanent lockout trip mechanism 1130 during a hazardous overload current condition when the Thermal Reed Switch 1112 and the solenoid 1122 are not damaged and are functioning properly. The temperature of the heat generating conductor 1120 recedes once power is removed from the load ending the hazardous overload current condition and leaving the temperature activated permanent lockout trip mechanism 1130 inactivated. The circuit interrupting device 1105 can then be reset by latching the latch again and turned back on applying power to the electrical circuit once again by closing the main contactor 1117. Obviously, it is recommended to investigate and remove the hazardous overload current condition in the electrical circuit prior to resetting the circuit interrupting device 1105 and turning it back on. However, should the temperature sensing switch 1125 or the solenoid 1122 become damaged or reach its end of life, the solenoid 1122 does not become energized or does not generate sufficient force to unlatch the latch. Thus, the main contactor 1117 remains closed and the hazardous overload current condition persists. As a result, the temperature of the heat generating conductor 1120 continues to rise until it reaches the predefined temperature of the temperature activated permanent lockout trip mechanism 1130, at which point the solder melts and the temperature activated permanent lockout trip mechanism 1130 generates a force moving an armature that unlatches the latch releasing a spring to open the main contactor 1117 removing power from the electrical circuit. The temperature activated permanent lockout trip mechanism 1130 also inhibits the latch from latching which permanently prevents a reset, disabling the main contactor 1117 from ever closing again and reconnecting power to the electrical circuit.

Suppose the current required to energize the solenoid 1122 exceeds the current rating of the Thermal Reed Switch 1112. Instead of utilizing a custom designed Temperature Sensing Switch or a Thermal Reed Switch that has a current rating to safely and repeatedly supply the current required to energize the solenoid 1122, an off-the-shelf Thermal Reed Switch can be utilized to turn on a solid state switch that has a current rating to safely and repeatedly supply the current required to energize the solenoid 1122 and trip the circuit interrupting device 1105.

Figure 12:
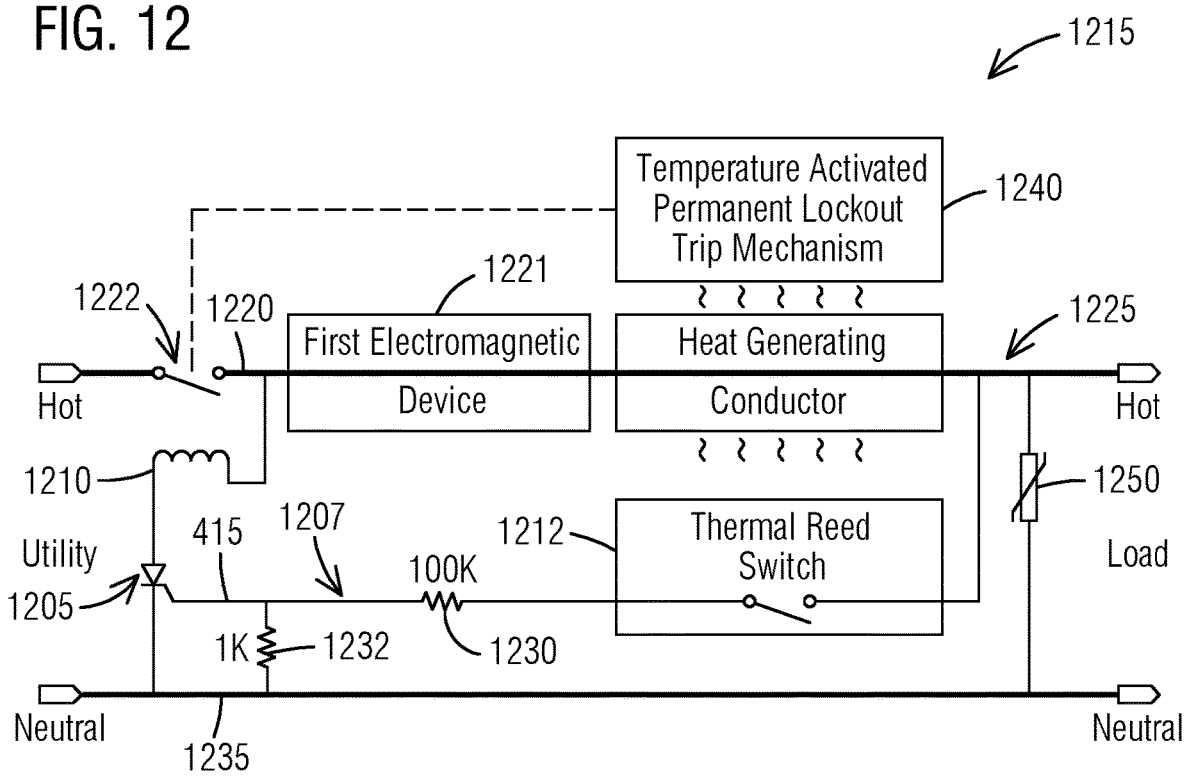
FIG. 12 illustrates an alternative embodiment which includes a Silicone-Controlled Rectifier (SCR) and a resistor divider as the current required to directly energize a solenoid exceeds the current rating of the Thermal Reed Switch.

FIG. 12 illustrates an alternative embodiment which includes a Silicone-Controlled Rectifier (SCR) 1205 and a resistor divider 1207 as the current required to directly energize a solenoid 1210 exceeds the current rating of a Thermal Reed Switch 1212. FIG. 12 describes a circuit interrupting device 1215 that consists of a hot or energizing conductor 1220, a main contactor 1222 that is spring loaded but held in a closed switch position using a latch, a first electromagnetic device 1221 configured to instantaneously generate magnetic force capable of unlatching the latch releasing a spring to open the main contactor 1222 removing power from the electrical circuit when a hazardous overload current exceeds 800% of rated load current, a section of conductor 1225 that generates heat. The circuit interrupting device 1215 further comprises the Thermal Reed Switch 1212 (part number TRS1-120MCR01VU manufactured by Kemet Electronics Corporation) located in close proximity to the section of conductor 1225 that generates heat which closes its contacts when the Currie temperature of 120° C. is reached in response to a hazardous overload current in which a thermal switch electrically couples power from the hot conductor 1220 to the gate of the Silicone-Controlled Rectifier (SCR) 1205 (part number S8X8BSRP manufactured by LittelFuse Inc.) through the resistor divider 1207 consisting of a 100K Ohm resistor 1230 and a 1K Ohm resister 1232, which turns on and energizes the solenoid 1210 that is disposed across the hot conductor 1220 and a connection to a neutral conductor 1235 through the SCR 1205. The circuit interrupting device 1215 further comprises a temperature activated permanent lockout trip mechanism 1240 utilizing the fusible metal 'Indium 100' (as described above and in FIGS. 6-9) located in close proximity to the section of conductor 1225 that generates heat. The energized solenoid 1210 generates magnetic force capable of moving an armature that unlatches the latch releasing a spring to open the contactor switch removing power from the electrical circuit. The temperature activated permanent lockout trip mechanism 1240 upon reaching the fusible metal's melting temperature of 157° C. also generates a force capable of moving an armature that unlatches the latch releasing a spring to open the main contactor 1222 removing power from the electrical circuit. Once activated, the temperature activated permanent lockout trip mechanism 1240 inhibits the latch from latching which permanently prevents a reset, disabling the main contactor 1222 from ever closing again and reconnecting power to the electrical circuit. A Metal Oxide Varistor (MOV) 1250 (part number ERZE11A241 manufactured by Panasonic) is disposed across the hot conductor 1220 and a connection to the neutral conductor 1235 to protect the SCR 1205 and the Thermal Reed Switch 1212 from high voltage surges.

Figure 13:
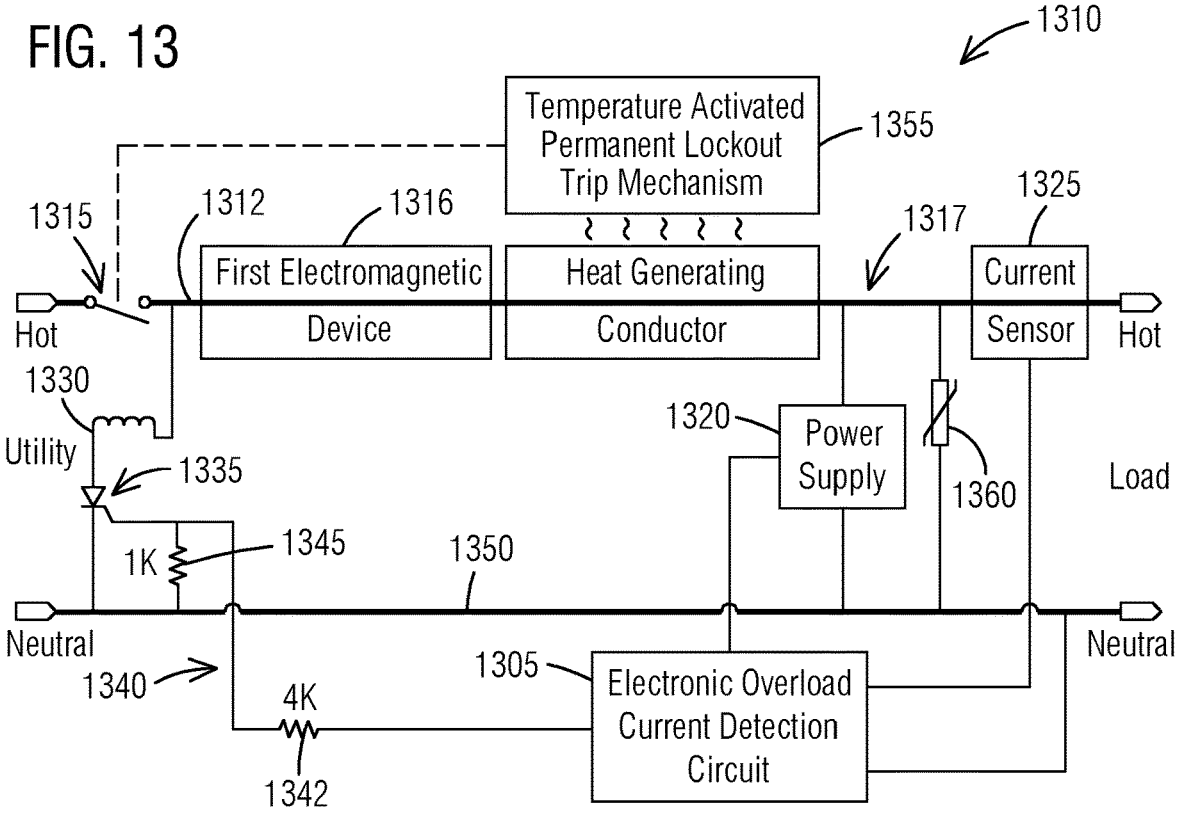
FIG. 13 illustrates another alternative embodiment where the temperature sensing switch is replaced by an electronic overload current detection circuit to detect hazardous overload current between 135% and 800% of rated current.

FIG. 13 illustrates another alternative embodiment where a temperature sensing switch is replaced by an electronic overload current detection circuit 1305 to detect hazardous overload that exceeds 135% of a rated current to meet calibration standards defined in safety standard UL489. FIG. 13 describes a circuit interrupting device 1310 that consists of a hot or energizing conductor 1312, a main contactor 1315 that is spring loaded but held in a closed switch position using a latch, a first electromagnetic device 1316 configured to instantaneously generate magnetic force capable of unlatching the latch releasing a spring to open the contactor switch removing power from the electrical circuit when a hazardous overload current exceeds 800% of rated load current. The circuit interrupting device 1310 further comprises a section of conductor 1317 that generates heat and the electronic overload current detection circuit 1305 configured to detect hazardous overload that exceeds 135% of a rated current. The circuit interrupting device 1310 further comprises a power supply 1320 that supplies power from the conductor 1317 to the electronic overload current detection circuit 1305 and a current sensor 1325 configured to monitor the current in conductor 1317 and is coupled to the electronic overload current detection circuit 1305. The circuit interrupting device 1310 further comprises a second electromagnet in the form of a first solenoid 1330 and a Silicone-Controlled Rectifier (SCR) 1335 (part number S8X8BSRP manufactured by LittelFuse Inc.) configured to receive a trip signal from the electronic overload current detection circuit 1305 through a resistor divider 1340 consisting of a 4K Ohm resistor 1342 and a 1K Ohm resister 1345 which turns on and energizes the first solenoid 1330 that is disposed across the hot conductor 1312 and a connection to a neutral conductor 1350 through the SCR 1335. The circuit interrupting device 1310 further comprises a temperature activated permanent lockout trip mechanism 1355 utilizing the fusible metal 'Indium 100' (as described above and in FIGS. 6-9) located in close proximity to the section of conductor 1317 that generates heat. The current sensor 1325 can be any of a number of known methods such as a shunt resistance, a current transformer, or other magnetic field sensing device. The energized solenoid 1330 generates magnetic force capable of moving an armature that unlatches the latch releasing a spring to open the main contactor 1315 removing power from the electrical circuit. The temperature activated permanent lockout trip mechanism 1355 upon reaching the fusible metal's melting temperature of 157° C. also generates a force capable of moving an armature that unlatches the latch releasing a spring to open the main contactor 1315 removing power from the electrical circuit. Once activated, the temperature activated permanent lockout trip mechanism 1355 inhibits the latch from latching which permanently prevents a reset, disabling the main contactor 1315 from ever closing again and reconnecting power to the electrical circuit. A Metal Oxide Varistor (MOV) 1360 (part number ERZE11A391 manufactured by Panasonic) is disposed across the hot conductor 1312 and a connection to the neutral conductor 1350 to protect the SCR 1335, the power supply 1320, and the electronic overload current detection circuit 1305 from high voltage surges.

The electronic overload current detection circuit 1305 is configured to detect a hazardous overload current typically according to a calculation of the current squared times time exceeds a predefined constant to ensure that the circuit interrupting device 1310 complies with safety standard UL489. A predefined temperature threshold of the temperature activated permanent lockout trip mechanism 1355 is also selected to ensure compliance of safety standard UL489, but at a temperature higher than the typical temperature that the heat generating conductor 1317 reaches upon detection of a hazardous overload current condition by the electronic overload current detection circuit 1305. This allows the electronic overload current detection circuit 1305 to detect a hazardous overload current and assert a trip signal to the gate of SCR 1335 to energize the solenoid 1330 generating a force that unlatches the latch releasing a spring to open the main contactor 1315 removing power from the electrical circuit prior to activation of the temperature activated permanent lockout trip mechanism 1355 during a hazardous overload current condition as the temperature of the heat generating conductor 1317 rises. The temperature of the heat generating conductor 1317 recedes once power is removed from the load ending the hazardous overload current condition and leaving the temperature activated permanent lockout trip mechanism 1355 inactivated. The circuit interrupting device 1310 can then be reset by latching the latch again. Once reset, the circuit interrupting device 1310 can be turned back on, applying power to the electrical circuit once again by closing the main contactor 1315. Obviously, it is recommended to investigate and remove the hazardous overload current condition in the electrical circuit prior to resetting a circuit breaker and turning it back on. However, should the electronic overload current detection circuit 1305, the power supply 1320, the current sensor 1325, the SCR 1335, or the solenoid 1330 become damaged or reach its end of life, the solenoid 1330 does not become energized or does not generate sufficient force to unlatch the latch. Thus, the main contactor 1315 remains closed and the hazardous overload current condition persists. As a result, the temperature of the heat generating conductor 1317 continues to rise until it reaches the predefined temperature of the temperature activated permanent lockout trip mechanism 1355, at which point the temperature activated permanent lockout trip mechanism 1355 generates a force moving an armature that unlatches the latch releasing a spring to open the main contactor 1315 removing power from the electrical circuit. The temperature activated permanent lockout trip mechanism 1355 also inhibits the latch from latching again preventing the circuit interrupting device 1310 from being reset, permanently disabling the circuit interrupting device 1310 from ever closing the main contactor 1315 and reconnecting power to the electrical circuit.

Figure 14:
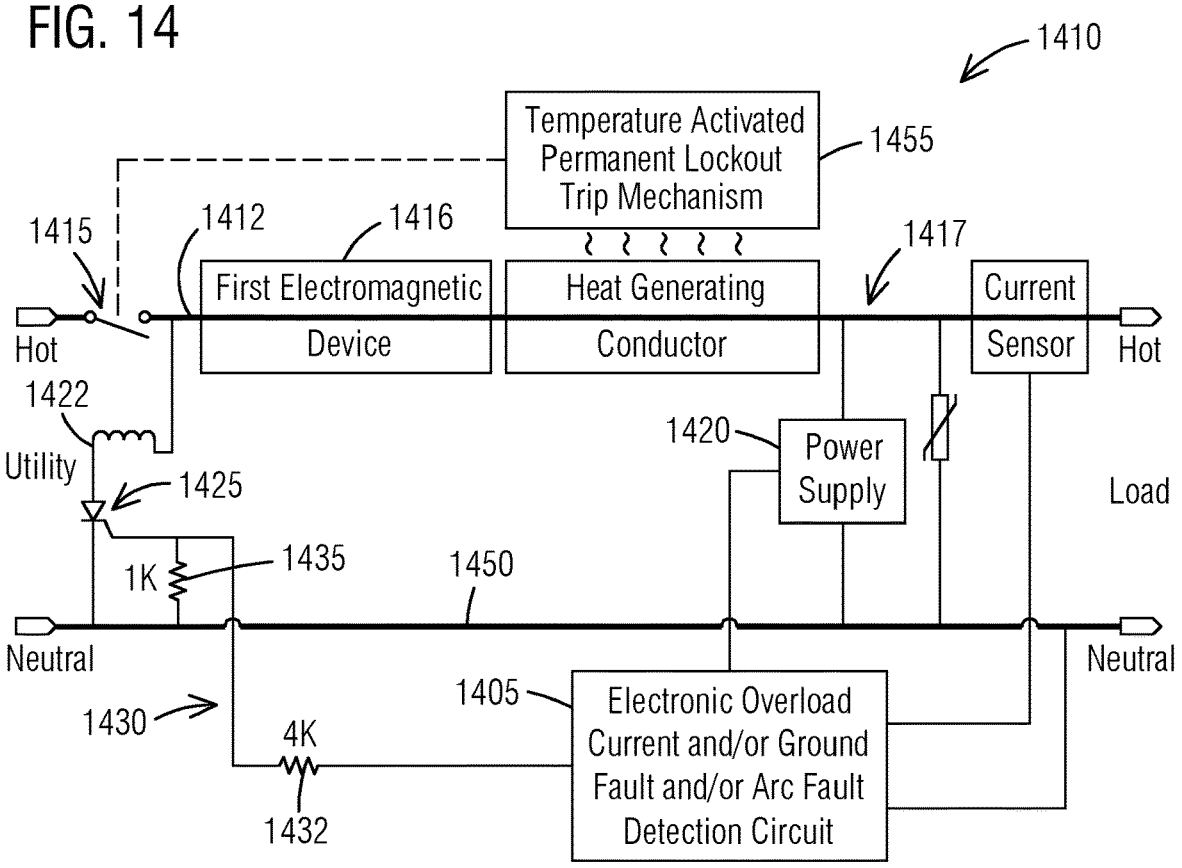
FIG. 14 illustrates an alternative embodiment that integrates nicely into an electronic ground fault and/or an arc fault circuit interrupting device.

FIG. 14 illustrates an alternative embodiment that integrates nicely into an electronic ground fault and/or an arc fault circuit interrupting device. This alternative embodiment integrates nicely into an electronic ground fault and/or arc fault circuit interrupting device as shown in FIG. 14 where the electronic overload current detection circuit in the alternative embodiment shown in FIG. 13 can be amended to by including a ground fault detection circuit and/or an arc fault detection circuit 1405. Sensors for ground fault detection and or arc fault detection are not shown. FIG. 14 describes a circuit interrupting device 1410 that consists of a hot or energizing conductor 1412, a main contactor 1415 that is spring loaded but held in a closed switch position using a latch and a first electromagnetic device 1416 configured to instantaneously generate magnetic force capable of unlatching the latch releasing a spring to open the main contactor 1415 removing power from the electrical circuit when a hazardous overload current exceeds 800% of rated load current. The circuit interrupting device 1410 further comprises a section of conductor 1417 that generates heat, a power supply 1420 and a second electromagnet in the form of a first solenoid 1422. The circuit interrupting device 1410 further comprises a Silicone-Controlled Rectifier (SCR) 1425 (part number S8X8BSRP manufactured by LittelFuse Inc.) configured to receive a trip signal from the electronic overload current and/or ground fault detection and/or the arc fault detection circuit 1405 through a resistor divider 1430 consisting of a 4K Ohm resistor 1432 and a 1K Ohm resister 1435 which turns on and energizes the solenoid 1422 that is disposed across the hot conductor 1412 and a connection to a neutral conductor 1450 through the SCR 1425. The circuit interrupting device 1410 further comprises a temperature activated permanent lockout trip mechanism 1455 utilizing the fusible metal 'Indium 100' (as described above and in FIGS. 6-9) located in close proximity to the section of conductor 1417 that generates heat.

Figure 15A:
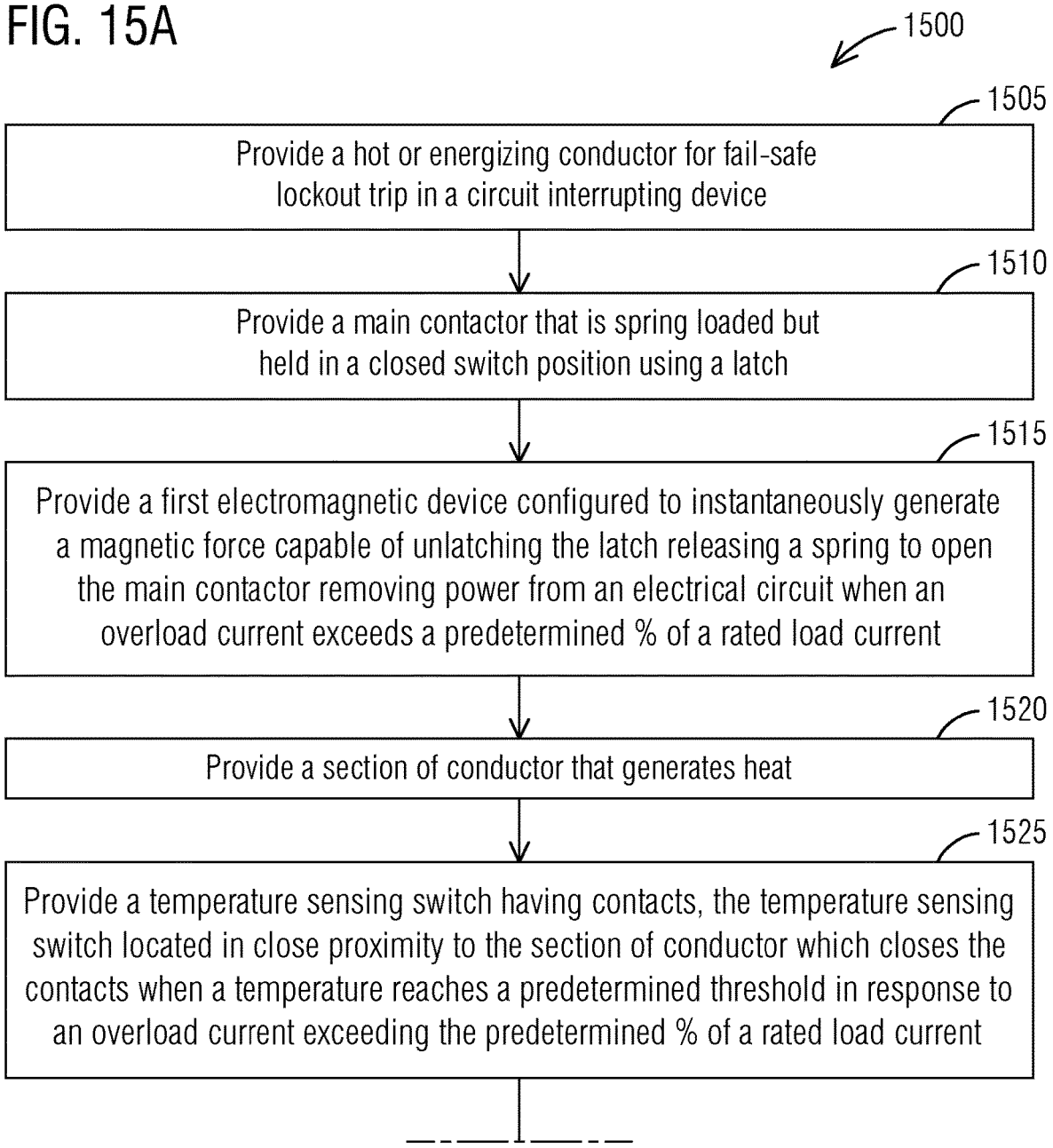
FIG. 15A and FIG. 15B are top and bottom partial figures of FIG. 15 respectively.
Figure 15B:
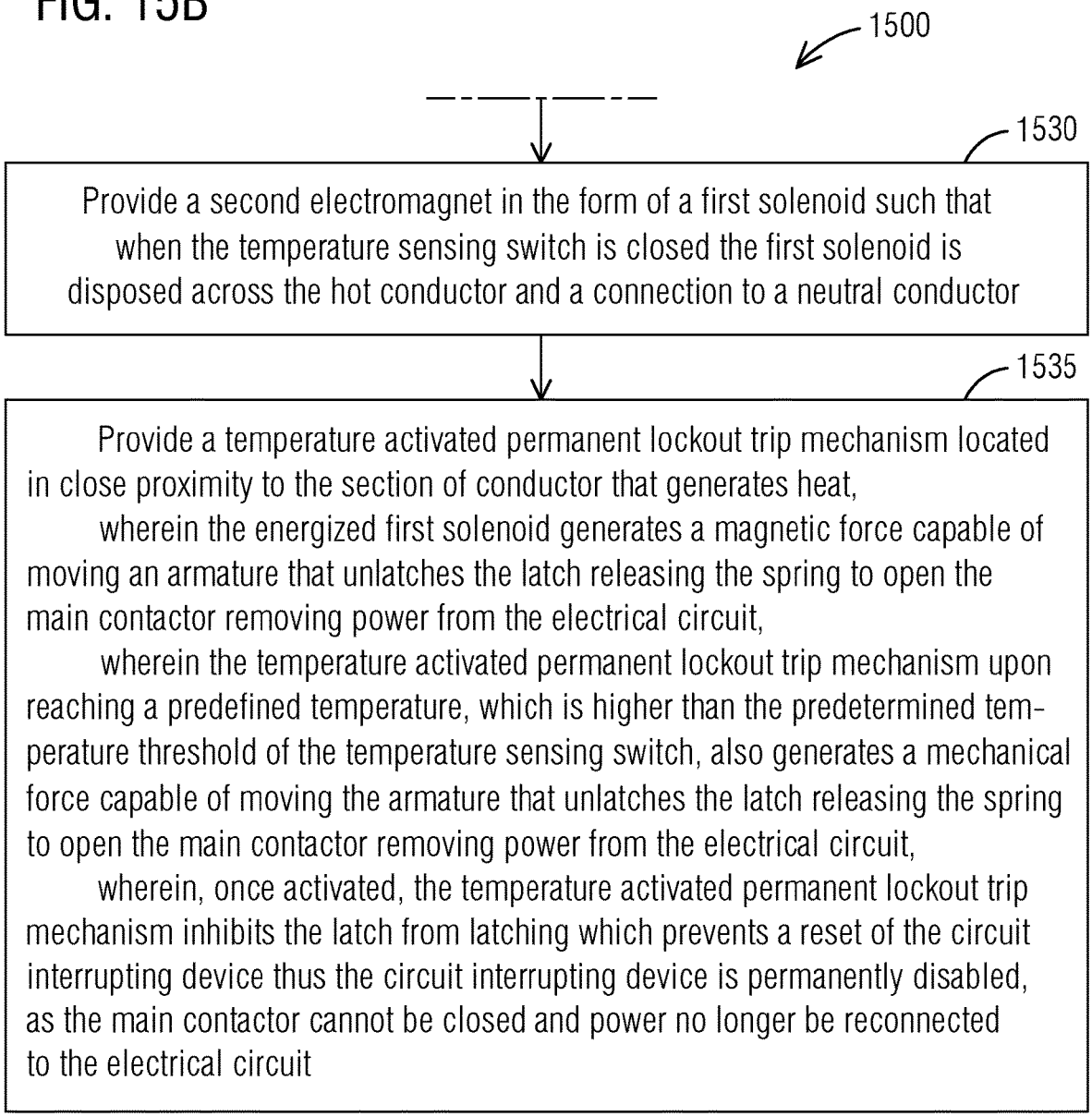

FIG. 15 illustrates a schematic view of a flow chart of a method 1500 for fail-safe lockout trip in the circuit interrupting device 105 in accordance with an exemplary embodiment of the present invention. Reference is made to the elements and features described in FIGS. 1-14. It should be appreciated that some steps are not required to be performed in any particular order, and that some steps are optional. FIG. 15A and FIG. 15B are top and bottom partial figures of FIG. 15 respectively.

The method 1500 comprises a step 1505 of providing a hot or energizing conductor. The method 1500 further comprises a step 1510 of providing a main contactor that is spring loaded but held in a closed switch position using a latch. The method 1500 further comprises a step 1515 of providing a first electromagnetic device configured to instantaneously generate a magnetic force capable of unlatching the latch releasing a spring to open the main contactor removing power from an electrical circuit when a hazardous overload current exceeds a predetermined % of a rated load current. The method 1500 further comprises a step 1520 of providing a section of conductor that generates heat.

The method 1500 further comprises a step 1525 of providing a temperature sensing switch having contacts. The temperature sensing switch is located in close proximity to the section of conductor which closes the contacts when a temperature reaches a predefined temperature threshold in response to a hazardous overload current exceeding a predetermined % of a rated load current which is less than the predetermined % of rated load current mentioned in step 1515. The method 1500 further comprises a step 1530 of providing a second electromagnet in the form of a first solenoid such that when the temperature sensing switch is closed the first solenoid is disposed across the hot conductor and a connection to a neutral conductor. The method 1500 further comprises a step 1535 of providing a temperature activated permanent lockout trip mechanism located in close proximity to the section of conductor that generates heat.

The energized first solenoid generates a magnetic force capable of moving an armature that unlatches the latch releasing the spring to open the main contactor removing power from the electrical circuit. The temperature activated permanent lockout trip mechanism upon reaching a predefined temperature also generates a mechanical force capable of moving the armature that unlatches the latch releasing the spring to open the main contactor removing power from the electrical circuit. Once activated, the temperature activated permanent lockout trip mechanism inhibits the latch from latching which prevents a reset of the circuit interrupting device 105 thus the circuit interrupting device 105 is permanently disabled, and power can no longer be reconnected to the electrical circuit.

While a fused metal-based temperature activated permanent lockout trip mechanism is described here a range of one or more other types of temperature activated permanent lockout trip mechanisms or other forms of temperature activation are also contemplated by the present invention. For example, other types of temperature activation components may be implemented based on one or more features presented above without deviating from the spirit of the present invention.

The techniques described herein can be particularly useful for an electronic ground fault and/or arc fault circuit interrupter. While particular embodiments are described in terms of specific ground fault and/or arc fault configuration and specific circuit breakers, the techniques described herein are not limited to such a limited configuration and circuit breakers but can also be used with other configurations and circuit breakers.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A circuit interrupting device, comprising:

an energizing conductor;

a main contactor that is spring loaded but held in a closed switch position using a latch;

a first electromagnetic device configured to instantaneously generate a magnetic force capable of unlatching the latch releasing a spring to open the main contactor removing power from an electrical circuit when an overload current exceeds a predetermined % of a rated load current;

a section of conductor that generates heat;

a temperature sensing switch having contacts, the temperature sensing switch located in close proximity to the section of conductor which closes the contacts when a temperature reaches a predetermined temperature threshold in response to an overload current less than the predetermined % of a rated load current;

a second electromagnet in the form of a first solenoid such that when the temperature sensing switch is closed the first solenoid is disposed across the energizing conductor and a connection to a neutral conductor; and a temperature activated permanent lockout trip mechanism located in dose substantial proximity to the section of conductor that generates heat, wherein the energized first solenoid generates a magnetic force capable of moving an armature that unlatches the latch releasing the spring to open the main contactor removing power from the electrical circuit, wherein the temperature activated permanent lockout trip mechanism upon reaching a predetermined temperature which is higher than the predetermined temperature threshold of the temperature sensing switch also generates a mechanical force capable of moving the armature that unlatches the latch releasing the spring to open the main contactor removing power from the electrical circuit, wherein, once activated, the temperature activated permanent lockout trip mechanism inhibits the latch from latching which prevents a reset of the circuit interrupting device thus the circuit interrupting device is permanently disabled as the main contactor cannot be closed, and power cannot be reconnected to the electrical circuit.

2. The circuit interrupting device of claim 1, wherein the temperature activated permanent lockout trip mechanism comprises fusible metal to hold a plunger in place that has a constant force exerted on it by either a compressed or a stretched spring.

3. The circuit interrupting device of claim 2, wherein the fusible metal is located near the section of conductor that generates heat and configured such that when the fusible metal melts the plunger is released allowing the spring to convert its potential energy into kinetic energy, moving the plunger to generate a mechanical force to unlatch the latch releasing the spring to open the main contactor removing power from the electrical circuit.

4. The circuit interrupting device of claim 2, wherein the temperature activated permanent lockout trip mechanism comprises a low-melting point metal or metal alloy.

5. The circuit interrupting device of claim 2, wherein the temperature activated permanent lockout trip mechanism comprises solder or Indium 100.

6. The circuit interrupting device of claim 1, wherein the temperature activated permanent lockout trip mechanism is a fail-safe backup mechanism to permanently remove power from the electrical circuit within calibration trip time limits specified in UL489 when the first solenoid or the second electromagnet or a thermal or a solid-state switch becomes damaged and/or inoperable.

7. The circuit interrupting device of claim 1, wherein the temperature sensing switch is a normally closed "break" switch that opens the contacts at a predetermined temperature threshold.

8. The circuit interrupting device of claim 1, wherein the predefined temperature threshold is selected to ensure compliance with a safety standard UL489.

9. The circuit interrupting device of claim 1, wherein the predefined temperature threshold of the temperature activated permanent lockout trip mechanism is selected to ensure compliance of a safety standard UL489, but at a higher temperature than the predefined temperature threshold of the temperature sensing switch.

10. The circuit interrupting device of claim 1, wherein the circuit interrupting device can then be reset under normal operation in response to a hazardous overload current condition by latching the latch again and once reset, the circuit interrupting device can be turned back on, applying power to the electrical circuit once again by closing the main contactor.

11. The circuit interrupting device of claim 1, wherein the temperature activated permanent lockout trip mechanism consists of a non-metallic plunger, a metal spring and a metallic washer.

12. The circuit interrupting device of claim 1, further comprising:

a trip armature that is configured to unlatch the latch when force is applied by a non-metallic plunger, releasing the spring to open the main contactor thus removing power from the electrical circuit.

13. The circuit interrupting device of claim 1, further comprising:

a non-metallic enclosure for the circuit interrupting device that holds the temperature activated permanent lockout trip mechanism in place and provides a fixed-point reference for a spring force.

14. The circuit interrupting device of claim 1, wherein a fusible metal is fused to a metallic washer in two places positioned in grooves of a non-metallic plunger such that when the temperature of the fusible metal reaches its melting point the fusible metal becomes a liquid and is no longer affixed to the metallic washer, allowing the non-metallic plunger to move in the direction of a trip armature.

15. The circuit interrupting device of claim 1, wherein the predetermined % of the rated load current is 800%.

16. A method for fail-safe lockout trip in a circuit interrupting device, the method comprising:

providing an energizing conductor;

providing a main contactor that is spring loaded but held in a closed switch position using a latch;

providing a first electromagnetic device configured to instantaneously generate a magnetic force capable of unlatching the latch releasing a spring to open the main contactor removing power from an electrical circuit when an overload current exceeds a predetermined % of a rated load current;

providing a section of conductor that generates heat;

providing a temperature sensing switch having contacts, the temperature sensing switch located in close substantial proximity to the section of conductor which closes the contacts when a temperature reaches a predefined temperature threshold in response to an overload current less than the predetermined % of a rated load current;

providing a second electromagnet in the form of a first solenoid such that when the temperature sensing switch is closed the first solenoid is disposed across the energizing conductor and a connection to a neutral conductor; and providing a temperature activated permanent lockout trip mechanism located in close proximity to the section of conductor that generates heat, wherein the energized first solenoid generates a magnetic force capable of moving an armature that unlatches the latch releasing the spring to open the main contactor removing power from the electrical circuit, wherein the temperature activated permanent lockout trip mechanism upon reaching a predefined temperature which is higher than the predetermined temperature threshold of the temperature sensing switch also generates a mechanical force capable of moving the armature that unlatches the latch releasing the spring to open the main contactor removing power from the electrical circuit, wherein, once activated, the temperature activated permanent lockout trip mechanism inhibits the latch from latching which prevents a reset of the circuit interrupting device thus the circuit interrupting device is permanently disabled as the main contactor cannot be closed, and power cannot be reconnected to the electrical circuit.

17. The method of claim 16, wherein the temperature activated permanent lockout trip mechanism is a fail-safe backup mechanism to permanently remove power from the electrical circuit within calibration trip time limits specified in UL489 when the first solenoid or the second electromagnet or a thermal or a solid-state switch becomes damaged and/or inoperable.

18. The method of claim 16, wherein the temperature activated permanent lockout trip mechanism comprises fusible metal to hold a plunger in place that has a constant force exerted on it by either a compressed or a stretched spring.

19. A circuit interrupting device, comprising:

a temperature activated permanent lockout trip mechanism located in substantial proximity to a section of conductor that generates heat, wherein an energized first solenoid generates a magnetic force capable of moving an armature that unlatches a latch releasing a spring to open a main contactor removing power from an electrical circuit, wherein the temperature activated permanent lockout trip mechanism upon reaching a predetermined temperature which is higher than the predetermined temperature threshold of the temperature sensing switch also generates a mechanical force capable of moving the armature that unlatches the latch releasing the spring to open the main contactor removing power from the electrical circuit, wherein, once activated, the temperature activated permanent lockout trip mechanism inhibits the latch from latching which prevents a reset of the circuit interrupting device thus the circuit interrupting device is permanently disabled as the main contactor cannot be closed, and power cannot be reconnected to the electrical circuit.

20. The circuit interrupting device of claim 19, wherein the temperature activated permanent lockout trip mechanism comprises fusible metal to hold a plunger in place that has a constant force exerted on it by either a compressed or a stretched spring.

* * * * *